US009282403B1

(12) United States Patent
Torok et al.

(10) Patent No.: US 9,282,403 B1
(45) Date of Patent: Mar. 8, 2016

(54) USER PERCEIVED GAPLESS PLAYBACK

(71) Applicant: Rawles LLC, Wilmington, DE (US)

(72) Inventors: Fred Torok, Seattle, WA (US); Frédéric Johan Georges Deramat, Bellevue, WA (US); Vikram Kumar Gundeti, Seattle, WA (US)

(73) Assignee: Amazon Technologies, Inc, Seattle, WA (US)

( * ) Notice: Subject to any disclaimer, the term of this patent is extended or adjusted under 35 U.S.C. 154(b) by 196 days.

(21) Appl. No.: 13/907,390

(22) Filed: May 31, 2013

(51) Int. Cl.
*H04R 3/00* (2006.01)

(52) U.S. Cl.
CPC ..... *H04R 3/00* (2013.01)

(58) Field of Classification Search
CPC ..... G11B 2020/10768; G06F 17/30; G06F 17/30002; G06F 17/30017; G06F 17/30026; G06F 17/30053; G06F 17/3074; G06F 17/30743; G06F 17/30749; G06F 17/30752; G06F 17/30761; G06F 17/30766; G06F 17/30772; G06F 17/30775; G06F 17/30778; H04R 3/00; H04L 65/00; H04L 65/60; H04L 65/602; H04L 65/604; H04L 65/608; H04L 65/4092; H04L 65/4084
USPC ..... 700/94; 381/77
See application file for complete search history.

(56) References Cited

U.S. PATENT DOCUMENTS

| | | | | |
|---|---|---|---|---|
| 7,412,532 | B2 * | 8/2008 | Gondhalekar | H04N 21/23617 370/264 |
| 7,418,392 | B1 | 8/2008 | Mozer et al. | |
| 7,720,683 | B1 | 5/2010 | Vermeulen et al. | |
| 7,774,204 | B2 | 8/2010 | Mozer et al. | |
| 7,797,064 | B2 * | 9/2010 | Loomis et al. | 700/94 |
| 7,912,920 | B2 * | 3/2011 | Loomis | H04L 65/605 709/203 |
| 8,978,079 | B2 * | 3/2015 | Pfeffer | H04N 21/25891 725/118 |
| 9,026,033 | B2 * | 5/2015 | Khedouri et al. | 455/3.01 |
| 2010/0153846 | A1 * | 6/2010 | Roy | G06F 17/30749 715/716 |
| 2012/0223885 | A1 | 9/2012 | Perez | |
| 2014/0244013 | A1 * | 8/2014 | Reilly | 700/94 |

FOREIGN PATENT DOCUMENTS

WO WO2011088053 A2 7/2011

OTHER PUBLICATIONS

Pinhanez, "The Everywhere Displays Projector: A Device to Create Ubiquitous Graphical Interfaces", IBM Thomas Watson Research Center, Ubicomp 2001, Sep. 30-Oct. 2, 2001, 18 pages.

* cited by examiner

*Primary Examiner* — Vivian Chin
*Assistant Examiner* — Jason R Kurr
(74) *Attorney, Agent, or Firm* — Lee & Hayes, PLLC

(57) ABSTRACT

A computing system for selecting and providing content items to a device. The device is configured to output a first content item to a user and to detect events related to the output of the first content item and, in response, to provide a notification to a cloud service related to the event. The device is further configured to receive at least a second content item from the cloud services and to buffer the second content item while outputting the first content item.

20 Claims, 6 Drawing Sheets

USER PERCEIVED GAPLESS PLAYBACK

BACKGROUND

The use of whole home surround sound and ubiquitous computing devices is becoming more and more common. Many new homes and offices are built fully wired, while many old homes and offices utilize various wireless systems. Many different ways have been introduced to allow users to interact with computing devices, such as through mechanical devices (e.g., keyboards, mice, etc.), touch screens, motion, gesture, and even through natural language input such as speech. Furthermore, many of these devices are further connected to remote computing resources, such as cloud-based services, that extend functionality afforded by the local devices.

As computing devices in homes and offices continue to evolve, users expect a more seamless experience when interacting with cloud-based services through local devices. One particular user experience concerns playback of streaming music received from cloud-services. One of the challenges for providing cloud-based services to home or office systems, such as streaming music, is how to effectively reduce user perceived latency and lag time.

BRIEF DESCRIPTION OF THE DRAWINGS

The detailed description is described with reference to the accompanying figures. In the figures, the left-most digit(s) of a reference number identifies the figure in which the reference number first appears. The use of the same reference numbers in different figures indicates similar or identical components or features.

DETAILED DESCRIPTION

Overview

Figure 1:
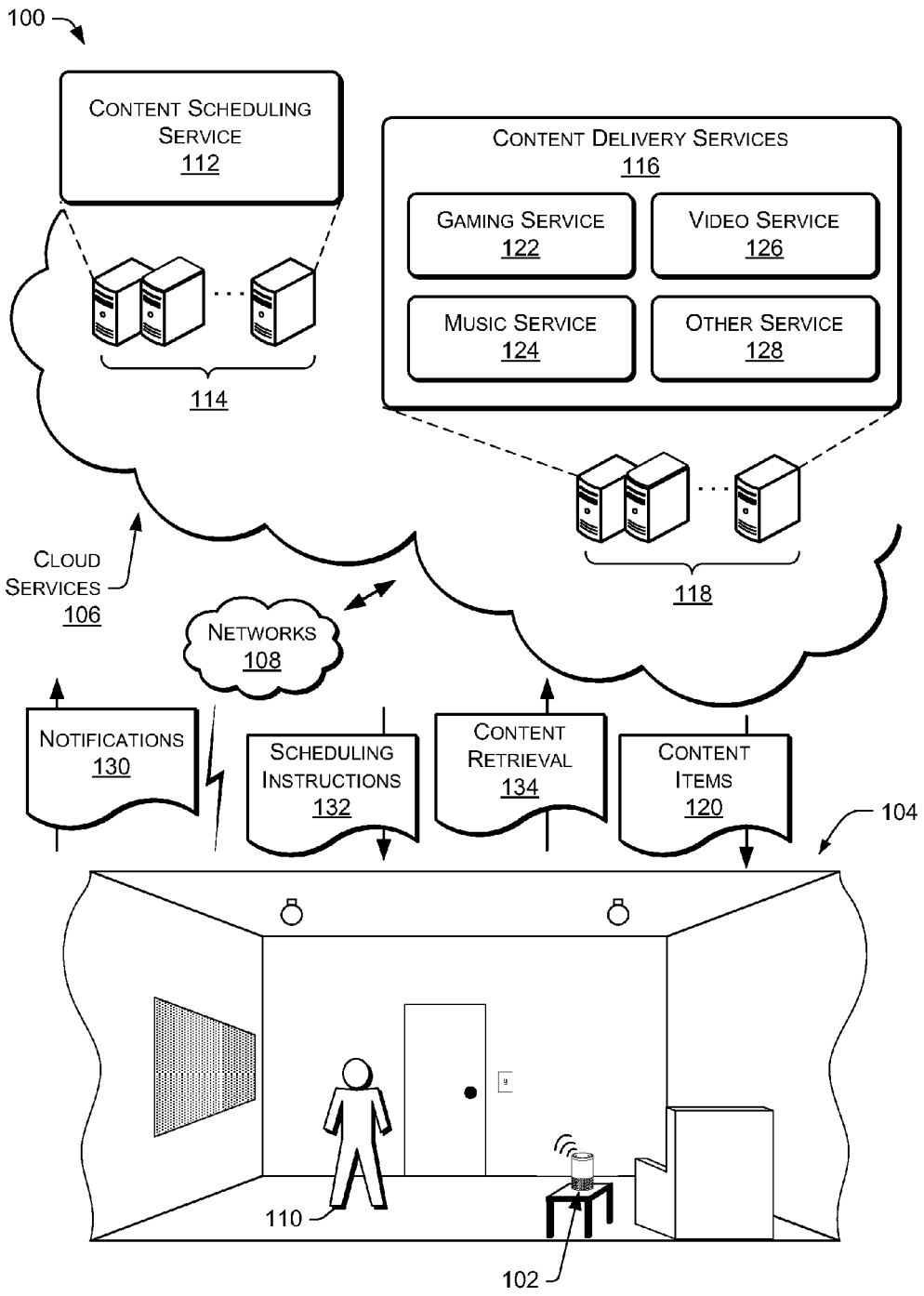
FIG. 1 illustrates an example home environment including a computing device physically situated in the home, but communicatively coupled to remote cloud-based services accessible via a network.

This disclosure includes techniques and implementations to improve performance of home and office computing systems when interacting with cloud services. In particular, this disclosure describes ways to improve user experience during playback of streaming content received from cloud services. One way to improve performance is to provide user perceived gapless playback. For instance, in many systems when switching between content items being streamed over a network, the users perceives a pause or break in output as the computing device buffers at least a portion of the next content item before output begins. This user experience is unfortunately not comparable to local systems in which the content items are stored locally and switching among items results in little or no gap in playback between items.

The techniques described herein achieve user perceived gapless playback by utilizing notifications from the computing devices to the cloud services and by pre-buffering anticipated next content items on the computing devices. For example, the next anticipated items may be based on a playlist, historical information about one or more users, stored user habits recommendations from the cloud services, etc. Accordingly, the computing devices are configured to monitor the user's progress through a content item and to provide notifications to the cloud services corresponding to the user's progress. The cloud services are configured to receive the notifications, select content items for output by the computing devices, identify the computing devices to provide the selected content items to, and provide the content items to the identified computing devices based on the notifications received.

In one example, the cloud services stream music from a user selected playlist to a computing device located in the user's home. In this example, the computing device may be configured to notify the cloud services when the current song has a specified amount of playtime remaining (e.g., one minute), such that the cloud services are able to select the next song from the user's playlist and to provide the song to the computing device. The computing device is then able to pre-buffer at least a portion of the next song before the current song ends. In this manner, the computing device is able to begin outputting the next song immediately following the end of the current song and the user experiences substantially gapless playback between songs.

In another instance, the computing device may be configured to keep multiple songs fully buffered in case the user decides to skip one or more songs. In this instance, the computing device may be configured to provide a notification to the cloud services each time a buffered song begins playback and an indication of the number of songs that need to be provided. For example, if the current song ends and the user decides to skip the next two songs, the computing device may notify the cloud services that the current song ended, the user skipped two songs, and that the cloud services should select three songs to buffer on the computing device.

In one particular implementation, the computing device may be configured to store enough content of each song related to an active or last used playlist to provide gapless playback (e.g., 3 to 10 seconds of each song). Thus, if the user skips several songs in a row and arrives at a song that is not buffered, the computing device is able to begin buffering the rest of the song, while outputting the stored content, such that the user still experiences substantially gapless playback.

In one example, the computing devices may be configured to provide notifications to the cloud services, such as "Playback Started," "Playback Paused," "Playback Stopped," "Playback Resumed," "Playback Half Finished," "Playback Nearly Finished" and/or "Playback Finished." In another example, the computing devices may be configured to provide a notification to the cloud services at periodic or regular intervals, such as every 30 seconds, every minute, or every five minutes to update the cloud services as to the user's progress. In this way, the cloud services may be able to more accurately identify a time at which to begin transmitting the next content item for buffering on the local computing device. The notifications may also include additional information, such as the number of pauses, a frequency of pauses, time remaining, amount of content consumed, amount of content remaining, average rate of consumptions, network conditions, among others. In some instances elements of the notification, such as the time that a notification is sent, may be configured by the user and/or the cloud services based on user preferences, user history, network history, current network conditions, data related to the outputting device and or/other information collected from or provided by the user.

For example, the cloud services may include a network monitoring module to monitor network conditions associated with the user's computing device, such as latency, lag and bandwidth, as well as, a time module to determine when the next content item should begin buffering on the computing device based on the network conditions (either received as part of the notification and/or determined by the monitoring module) and the user preferences. For example, if a particular user has a lower bandwidth network connection, the cloud services may begin buffering content items on the computing device earlier than in other systems. In another example, the user may have a pay-per-byte data plan and prefer that a minimum amount of pre-buffering be performed. Thus, if the user stops consuming content, the user is not paying for multiple buffered songs, which are never consumed.

In one implementation, the cloud services may communicate with multiple computing devices, which are part of a whole home surround sound or computing system. In this implementation, each of the computing devices may be aware of the location of the other computing devices, as well as, any content and/or user profiles active on the other computing devices. This awareness may be achieved through intra-device communication via use of local ad-hoc networks, such as a wireless network (e.g., Wifi, Bluetooth®, etc.). Each computing device may also be configured to capture audio and/or visual information from the surrounding environment and to identify users in the environment based on the audio and/or visual information. The cloud service may also be aware of the presence and location (or relative locations) of each of the computing devices of the system to coordinate buffering of content items between multiple computing devices of the system.

For example, the user may be physically located in the living room and listening to streaming music through a first computing device of the system. The system may also include a second computing device located in the kitchen and a third computing device located in the home office. In this example, the cloud services may buffer the next song on the first computing device in the living room, as well as, the second and/or third computing devices in anticipation that the user may move from the living room to the kitchen or office. In one instance, the cloud services may also buffer and provide an indication of the user's progress through the current song on the second and third computing devices, such that either device may pick up where the first device left off if the user switches devices. In this manner, the user may move from room to room or device to device, while experiencing substantially gapless playback. In one particular implementation, the cloud service or one of the computing devices may store information about the user's past routine and pre-buffer content items based on the expected location of the user at given time. For example, the user may eat dinner at 6:00 pm every day and the system may buffer one or more content item on the second device at five minutes to 6:00 pm and begin outputting the buffered content item at 6:00 pm.

In another implementation, the cloud services may be configured to buffer different content items on two or more of the multiple computing devices of the system at the same time. For example, a first user may be listening to a first playlist in the living room using a first computing device, while a second user may be listening to a second playlist in the office using a second computing device. The cloud services may be able to receive notifications from both computing device and to buffer the content items for both devices taking into consideration that both the first and second computing devices are utilizing the same network and, for example, provide the content items to buffer earlier to compensate for the increased network load.

In one particular example, the cloud services may be configured to provide two different content items from the same playlist to two computing devices at the same time. For instance, two family members may be listing to different songs of the family playlist in different rooms of the home. The cloud services may also be configured to track and store each member of the family's location within the family playlist, such that each family member may restart the playlist at the point at which the particular family member left off from. In some implementations, the cloud services may also keep track of a user's progress through multiple playlists, as well as, through content items that are buffered on each of the computing devices of the system. For example, a user may consume content items at a computing device in the kitchen during breakfast. The user may then leave for work, while the computing device is in the middle of a content item. The cloud service may receive a notification from the computing device that the user has stopped consuming content and the cloud service may note the location in the playlist and content item. In some instances, the computing device may maintain the buffered content items (i.e., the current and next content items) in temporary memory while the user is at work. Thus, when the user returns, the user may pick up where the user left off on the current content item and playlist without needing to wait for a content item to buffer. In this manner, the user experiences substantially gapless playback even after a long break in consuming content. In some implementation, the various operations to implement user perceived gapless playback may be split among the computing devices and the cloud services to which the computing devices may be coupled via a network. Different modules and functionality may reside locally in the devices proximal to the user, or remotely in the cloud servers. For instance, the cloud services may perform the content item selection, while the computing systems monitor the network conditions.

Illustrative Environment

FIG. 1 illustrates an example home environment 100 including a computing device 102 physically situated in the home 104, but communicatively coupled to remote cloud services 106 accessible via a network 108. In the illustrated implementation, the computing device 102 is positioned on a table within the home 104. In other implementations, it may be placed in any number of places (e.g., an office, store, public place, etc.) or locations (e.g., ceiling, wall, in a lamp, beneath a table, under a chair, etc.). Further, more than one computing device 102 may be positioned in a single room, or one computing device 102 may be used to accommodate user interactions from more than one room of the home. In one particular example, the computing device 102 may be configured to communicate with other home electronic devices to capture environmental noise and perform user requested actions.

The computing device 102 may be communicatively coupled to the networks 108 via wired technologies (e.g., wires, USB, fiber optic cable, etc.), wireless technologies (e.g., RF, cellular, satellite, Bluetooth, etc.), or other connection technologies. The networks 108 are representative of any type of communication network, including data and/or voice network, and may be implemented using wired infrastructure (e.g., cable, CATS, fiber optic cable, etc.), a wireless infrastructure (e.g., RF, cellular, microwave, satellite, Bluetooth, etc.), and/or other connection technologies. The networks 108 carry data, such as audio data, between the cloud services 106 and the computing device 102.

In the illustrated example, the computing device 102 is configured to stream audio and other content from the cloud services 106, and to output the audio or other content to a user 110 located in the home 104. In one particular implementation, the computing device 102 is configured as a voice controlled assistant that is primarily an audio-based device, receiving verbal instructions from the user 110 and providing audio responses. The voice controlled assistant is equipped with one or more microphones and speakers, and has computing resources to process audio input. One particular implementation is described below in more detail with reference to FIG. 3.

The computing device 102 may also be configured to access cloud services 106 to perform database searches, locate and consume/stream other forms of entertainment (e.g., games, movies and/or other electronic content, etc.), aid in personal management tasks (e.g., calendaring events, taking notes, etc.), assisting in online shopping, conducting financial transactions, and so forth. In some instances, the computing device 102 is implemented without a haptic input component (e.g., keyboard, keypad, touch screen, joystick, control buttons, etc.) or a display. In other instances, a limited set of one or more haptic input components may be employed (e.g., a dedicated button to initiate a configuration, power on/off, etc.).

The cloud services 106 generally refer to a network accessible platform implemented as a computing infrastructure of processors, storage, software, data access, and so forth that is maintained and accessible via a network such as the Internet. The cloud services 106 do not require end-user knowledge of the physical location and configuration of the system that delivers the services. Common expressions associated with cloud services include "on-demand computing," "software as a service (SaaS)," "platform computing," "network accessible platform" and so forth.

The cloud services 106 include a content scheduling service 112 implemented by one or more servers 114 and one or more content delivery services 116 implemented by one or more servers 118. The servers 118 may host any number of cloud services 106 for providing digital content items 120 to the computing device 102, such as a gaming service 122, a music service 124, a video service 126 and/or other services 128, which may be utilized to stream or provide content items 120 to the computing device. The servers 114 may host any number of cloud services 106 to select, locate and provide the content items 120 to the computing device 102. These servers 114 and 118 may be arranged in any number of ways, such as server farms, stacks, and the like that are commonly used in data centers.

The computing device 102 receives content items 120 from the one of the content delivery services 116. In one implementation, the content items 120 comprise audio data that may be streamed from the cloud services 106. Such audio data may include songs, audio books, soundtracks, lectures, and the like. In other implementations, the content items may be other types of media, such as video, images or games. The computing device 102 is further configured to provide notifications 130 to the content scheduling service 112 based on progress made through the content items 120 to inform the content scheduling service 112 of whether additional content items 120 should be requested from one or more of the content delivery services 116.

Generally, the computing device 102 may be configured to output content items 120 received from the content delivery service 116 into the environment 100 for the enjoyment of the user 110 and to transmit notifications 130 related to the output of the content items 120 to content scheduling service 112. For example, the computing device 102 may be configured to provide notifications related to the output of a content item, such as "Playback Started," "Playback Paused," "Playback Stopped," "Playback Resumed," "Playback Half Finished," "Playback Nearly Finished" and/or "Playback Finished." In other examples, the computing device 102 may be configured to provide periodic notifications to the cloud services 106 at regular intervals during output of a content item.

The notifications 130 may also include information related to currently playing content item, such as the current progress, number of pauses, frequency of pauses, time remaining, amount of content consumed, amount of content remaining, average rate of consumptions, network conditions, among others. In some instances, elements of the notifications 130, such as the time that a notification is sent, may be configured by the user 110 and/or the content scheduling service 112 based on user preferences, user history, network history, current network conditions, data related to the outputting device and or/other information collected from or provided by the user 110.

The content scheduling service 112 receives the notifications 130 from the computing device 102 and selects content items 120 to buffer on the computing device 102 and one of the content delivery services 116 to provide the content item 120 to the computing device. The content scheduling service 112 may also determine the number of content items to buffer and when the buffering should begin based on the information provided in the notification 130, in addition to, user preferences, user history, network history, network conditions, data about the computing device 102 or/other information collected from or provided by the user 110. In one example, the content scheduling service 112 selects the content items 120 to buffer on the computing device 102 from, for example, a global playlist available via the network 108 or stored locally on one or more of the servers 114. In some cases, the playlists may be user specific, topic specific, system specific and/or environment specific. For instance, the user 110 may have a country playlist and a jazz playlist, while the home 104 may have an associated classical playlist, which the family of the user 110 uses when entertaining.

Once a content item 120 is selected by the content scheduling service 112, the content scheduling service 112 provides scheduling instructions 132 back to computing device 102. The scheduling instructions 132, generally, include data (or meta-data) instructing the computing device 102 with regards to which content item 120 to request and what content delivery service 116 to obtain the content item 120 from. For example, the scheduling instructions 132 may include the content item 120 selected by the content scheduling service 112 and a list of one or more uniform resource locator (URL) associated with one or more websites from which the computing device 102 may obtain the selected content item 120. In some cases, the scheduling instructions 132 may also include instructions related to alternative content items in case the computing device 120 is unable to obtain the selected content item 120 from the indicated content delivery service 116.

After receiving the scheduling instruction 132, the computing device 102 sends a content retrieval request 134 to one or more of the content delivery services 116. For example, the computing device 102 may receive scheduling instructions 134 indicating a song, which may be obtained from the music service 124 and, in response, provide a content retrieval request 134 to the music service 124. In another example, the computing device 102 may receive scheduling instructions 134 indicating a first content item, which may be obtained from the music service 124 and a second content item, which may be obtained from the video service 126. The computing device 102 may then generate two content retrieval requests 134 and provide one to the music service 124 and the other to the video service 126.

Upon receiving the content retrieval request 134, the content delivery service 116 begins streaming or downloading the requested content item 120 onto the computing device 102. In turn, the computing device 102 buffers the content item 120 for playback following the completion of output of the currently playing content item, as the content item 120 is received from the content delivery service 116.

In some cases, the content scheduling service 112 may take into consideration other factors when selecting a content item to buffer on the computing device. For example, the user 110 may have a limited data plan (e.g., the user 110 may only be able to download/upload a predetermined number of bytes-per-month). In this example, the content scheduling service 112 may be configured to cause a smaller portion of the next content item to buffer in order to conserve on data usage by providing scheduling instructions 132, which include a time at which to request the content item 120 from the indicated content delivery service 116. In other examples, the computing device 102 may determine the time at which to request the content item 120 from the indicated content delivery service 116, for instance, based on available space. In some cases, the content scheduling service 112 may also monitor the playback and download speeds based on the notifications 130 to determine the minimum amount of buffering in order to achieve user perceived gapless playback, while still efficiently utilizing the data plan.

In other instances, the content scheduling service 112 may cause the computing device 102 to keep a predetermined number of content items 120 fully buffered on the computing device 102 or a portion of each content item 120 related to the active playlist in case the user 110 decides to skip one or more of the content items 120. In this instance, the computing device 102 may provide additional notifications 130 to the content scheduling service 112 indicating the number of buffered content item 120 skipped. In some cases, the content scheduling service 112 may update a playlist to remove a content item 120 that was skipped. In other cases, the content scheduling service 112 may store information related to particular content items 120. For example, the content scheduling service 112 may store the number of times the user 110 skips a particular content item and remove the particular content item from one or more playlists if the particular content is skipped more than a threshold number of times.

In the illustrated example, the content scheduling service 112 and the content delivery services 116 are shown as two separate server systems. However, in some implementations the content scheduling service 112 may include one or more collections of content items 120 to provide to the computing device 102 in response to receiving the notifications 130. In this implementation, the content scheduling service 112 may select a content item 120 to buffer and provide the content item 120 directly to the computing device 102 in lieu of or in addition to the scheduling instructions 132.

Figure 2:
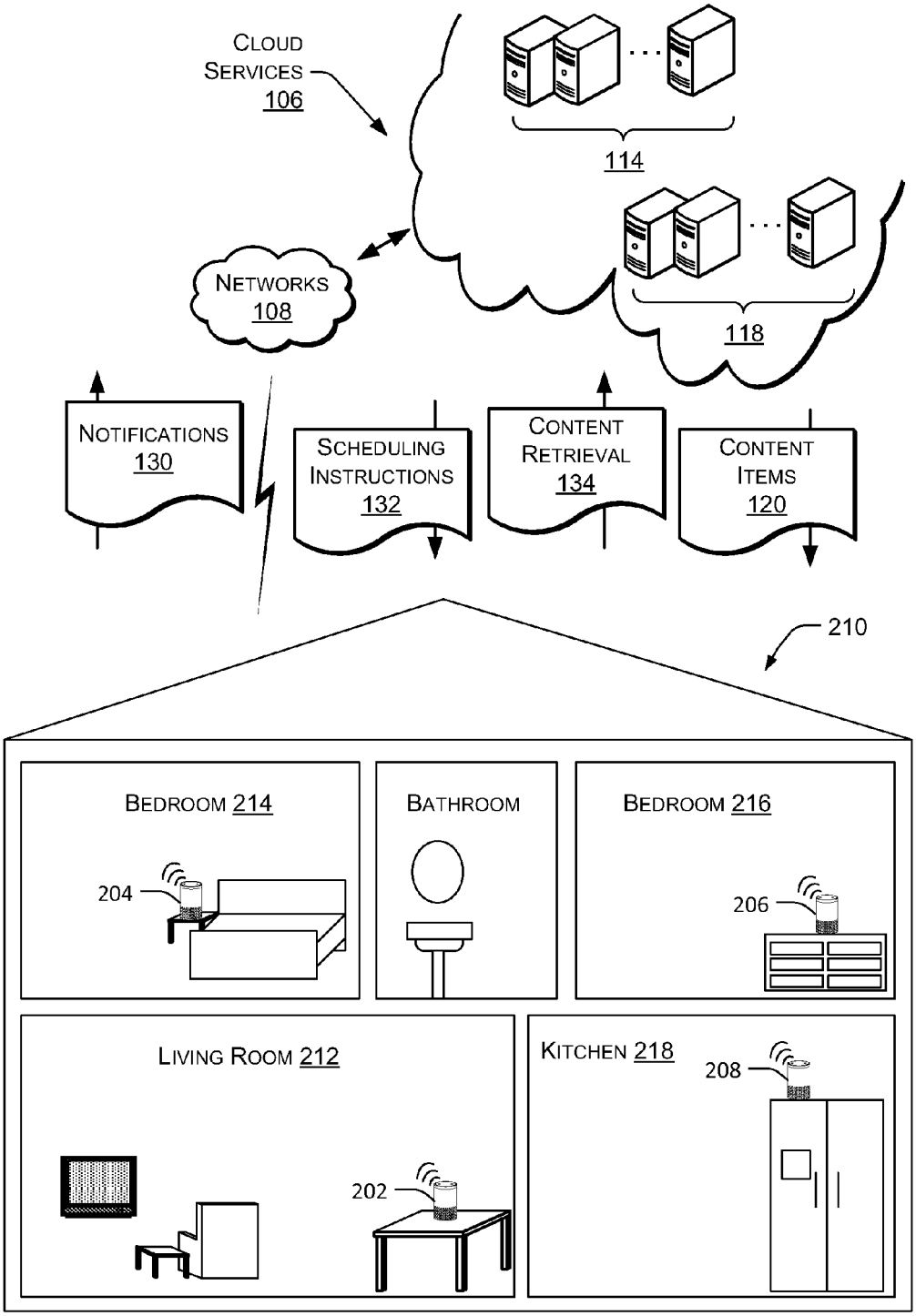
FIG. 2 illustrates an example home environment including multiple computing devices physically situated thought the home and communicatively coupled to remote cloud services accessible via a network.

FIG. 1 provides an example environment 100 including a system with a single computing device 102 to provide user perceived gapless playback of electronic content items. FIG. 2 shows another example environment illustrating a system with multiple computing devices spaced through the user's home.

FIG. 2 illustrates an example environment 200 including multiple computing devices 202, 204, 206 and 208 physically situated throughout a home 210 and communicatively coupled to the cloud services 106 accessible via the network 108. For example, the computing device 202 is located in the living room 212, the computing device 204 is located in a first bedroom 214, the computing device 206 is located in a second bedroom 216 and the computing device 208 is located in the kitchen 218.

The computing devices 202-208 may also be in communication with each other, one or more wireless access points, a master device and/or one or more other devices as part of an ad-hoc or home network system. The communication interfaces may support both wired and wireless connection to various networks, such as cellular networks, radio, WiFi networks, short-range or near-field networks (e.g., Bluetooth®), infrared signals, local area networks, wide area networks, the Internet, and so forth.

As described above, the computing devices 202-208 are configured to request, receive and output content items 120 from the cloud services 106 into the various rooms of environment 200 for the enjoyment of the users and to transmit notifications 130 related to the output of the content items 120 back to cloud services 106. Generally, a content scheduling service implemented as one of the cloud services 106 receives the notifications 130 from each of the computing devices 202-208 and, based on the notifications 130, selects additional content items 120 from playlists associated with various users accessing each of the computing devices 202-208 to buffer on the computing devices 202-208, as well as, a content delivery services from which to obtain the content items, such that the users experience substantially gapless playback while consuming content items 120.

In one example, a first user may be listening to a first playlist in the living room 212 using the computing device 202, while a second user may be listening to a second playlist in the bedroom 214 using the computing device 204. The content scheduling service receive notifications 130 from both computing devices 202 and 204 and based thereon, select one or more content items to buffer on each device. For instance, the content scheduling service may select a first content item to buffer on the computing device 202 based on the first user's playlist and a second content item to buffer on the computing device 204 based on the second user's playlist. In one particular example, the cloud services 106 may provide two different content items 120 from the same playlist to the computing devices 202 and 204, for example, if both the first and the second users are listing to the different content items in the same playlist.

The content scheduling service also selects a first content delivery service from which the first computing device 202 may retrieve the first content item and a second content delivery service form which the second computing device 204 may retrieve the second content item. In some cases, the content scheduling service may select the same content delivery service to provide both the first content item to the first computing device 202 and second content item to the second computing device 204. For instance, both the first and second users may have an account with the same music service (e.g., iTunes®, Pandora®, etc.). In other cases, the content scheduling service may select different content delivery services for the first content item and the second content item. For instance, the first user may have an account with iTunes®, while the second user may have an account with Pandora®.

In another example, the content scheduling service may select content items 120 and provide scheduling instructions 132 to multiple computing devices of the system based on notifications 130 received from one of the computing devices. For example, if the first user is consuming content items 120 on the computing device 202 in the living room 212, the content delivery service may cause the both the computing device 202 located in the living room 212 and the computing device 208 located in the kitchen 218 to obtain and buffer a single content item 120, in anticipation that the first user may move to the kitchen 218, for example, to get a snack. In one implementation, the content scheduling service may be aware of the locations of the computing devices 202-208 and cause the computing devices 202-208 to obtain and buffer the content items 120 based on the distance of the user from each of the computing device 202-208, historical habits of the users and the particular rooms in which the computing devices 202-208 are physically located.

In some instances, the computing devices 202-208 may be part of a whole home surround sound system in which each of the computing devices 202-208 are configured to output the same content items. In these instances, the content scheduling service may receive a notification 130 from one of the computing devices 202-208 and, in response, cause each of the computing device 202-208 to retrieve and buffer the same a content item 120. In one particular instance, one of the computing devices 202-208 or a wireless access points may act as a master device to communicate with both the content scheduling service and each of the content delivery services via the network 108. In this way, the master device is able to buffer the content item 120 and relay the content item 120 to each of the computing devices 202-208, such that network bandwidth may be conserved, as the content delivery service does not need to provide the same content item 120 directly to each of the computing devices 202-208.

In one particular example, the computing devices 202-208 may be equipped with one or more microphones to capture sound from the environment and/or one or more video capturing components (i.e., one or more cameras) to capture visual information from the environment. In this example, the computing devices 202-208 may track the movement of the users throughout the home 210 using the microphones and/or video capturing components and to provide notifications 130 to the content scheduling service related to the users movement, such that the content scheduling service may cause the computing devices 202-208 which the users are likely to encounter to obtain and buffer content items 120.

Illustrative Architecture

Figure 3:
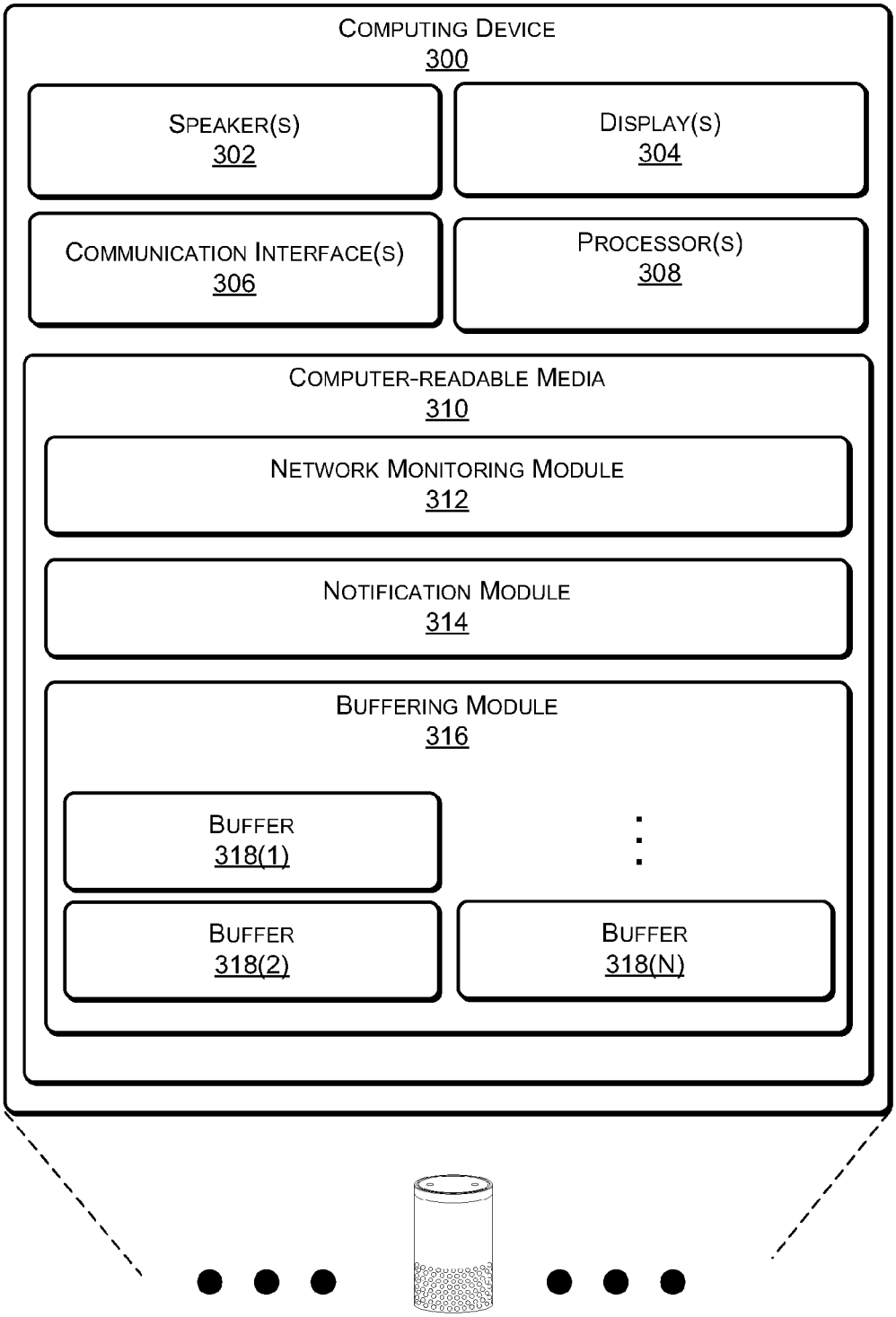
FIG. 3 illustrates an example architecture of a computing device, such as the computing devices in the environments of FIGS. 1 and 2.

FIG. 3 illustrates an example architecture of a computing device, such as the computing devices in the environments of FIGS. 1 and 2. Generally, the computing device 300 may be implemented as a standalone device that is relatively simple in terms of functional capabilities with limited input/output components, memory and processing capabilities or as part of a larger electronic system.

The computing device 300 may include one or more speakers 302 and one or more displays 304 to reproduce electronic content items for consumption by a user. The computing device 300 also includes one or more communication interfaces 306 to facilitate communication between one or more networks (such as network 108 of FIGS. 1 and 2) and/or one or more cloud services (such as the content scheduling service 112 and the content delivery services 116 of FIGS. 1 and 2). The communication interfaces 306 may also facilitate communication between one or more wireless access points, a master device and/or one or more other computing devices as part of an ad-hoc or home network system. The communication interfaces 306 may support both wired and wireless connection to various networks, such as cellular networks, radio, WiFi networks, short-range or near-field networks (e.g., Bluetooth®), infrared signals, local area networks, wide area networks, the Internet, and so forth.

The computing device 300 includes, or accesses, components such as at least one control logic circuit, central processing unit, one or more processors 308, in addition to one or more computer-readable media 310 to perform the function of the computing device 300 and or store content items. Additionally, each of the processors 308 may itself comprise one or more processors or processing cores.

Depending on the configuration of the computing device 300, the computer-readable media 310 may be an example of tangible non-transitory computer storage media and may include volatile and nonvolatile memory and/or removable and non-removable media implemented in any type of technology for storage of information such as computer-readable instructions or modules, data structures, program modules or other data. Such computer-readable media may include, but is not limited to, RAM, ROM, EEPROM, flash memory or other computer-readable media technology, CD-ROM, digital versatile disks (DVD) or other optical storage, magnetic cassettes, magnetic tape, solid state storage, magnetic disk storage, RAID storage systems, storage arrays, network attached storage, storage area networks, cloud storage, or any other medium that can be used to store information and which can be accessed by the processors 308.

Several modules such as instruction, data stores, and so forth may be stored within the computer-readable media 310 and configured to execute on the processors 308. Network monitoring module 312 is configured to monitor the available bandwidth and network usage by the computing device 300 and various other devices of the environment and a notification module 314 to provide notifications to the content scheduling service related to the consumption of content by the computing device 300. For example, the network monitoring module 312 may cause the processors to detect a slow down or overburden on the home network and the notification module 314 may cause the processors 308 to notify the content scheduling service of the network usage that the content scheduling service should consider reducing the number of content items that are being buffered on the computing device 300 at one time.

The computer-readable media 310 may also store a buffering module 316 to buffer various content items in buffers 318(1), 318(2) . . . 318(N). The number of buffers 318(1), 318(2) . . . 318(N) may vary depending on user settings, historical use, specifications of the computing device 300, network usage, and amount of content selected by the content scheduling service. In some implementations, the user may select between or cancel content items buffered in buffers 318(1)-(N).

Generally, the computing device 300 receives scheduling instructions from a content scheduling service to obtain and buffer content items, retrieves content items for output to a user from the one or more content delivery services and provides notifications related to the output of the content item back to the content scheduling service. For example, as a first content item is being output by the computing device 300, the computing device 300 receives scheduling instructions indicating one or more additional content item to obtain and store in one of the buffers 318(1)-(N) for output upon the completion of the first content item from the content scheduling service.

In one implementation, the computing device 300 may provide notifications related to the particular user, data related to the computing device 300 and/or information obtained by the network monitoring module 312 to the content scheduling service in addition to the notifications related to the output of the content item. For instance, the content scheduling service may determine the number of content items to buffer on the computing device 300 based on the user's preferences, the capabilities of the computing device 300, the network conditions and/or the type of content being output. For example, the user may have a preference to only buffer a portion of a content item if the content item is a movie but to buffer three content items if the content item is a song. In another example, the content scheduling service may attempt to cause the computing device 300 to buffer more content items than the buffers 318(1)-(N) can accommodate. In this example, the computing device 300 may provide a notification to the content scheduling service that a particular content item was dropped from the buffers 318(1)-(N) or that the computing device 300 is full. In this way, the content scheduling service can tailor the buffering process for the particulars of the computing device 300, in addition to, the user preferences.

Figure 4:
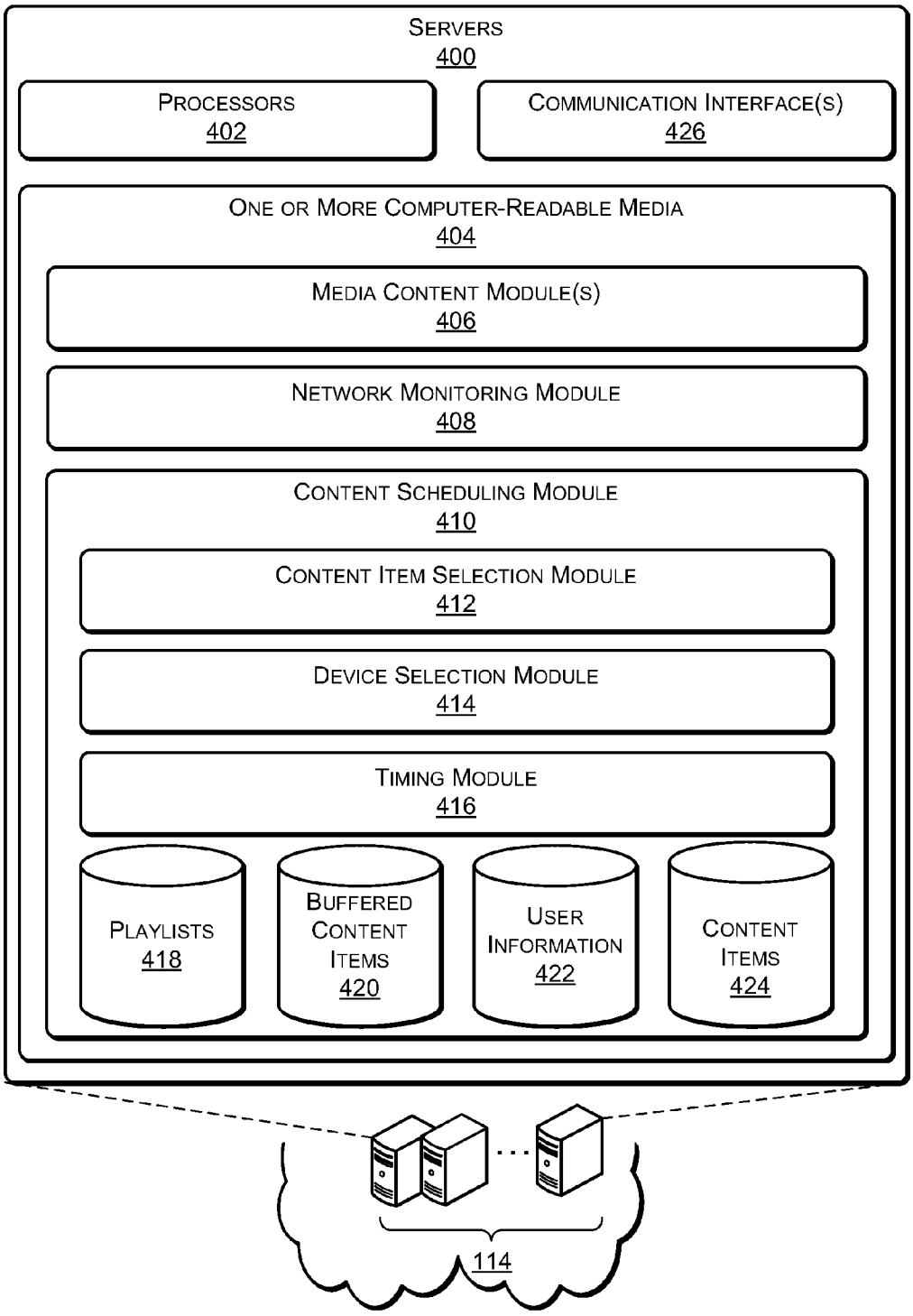
FIG. 4 illustrates an example architecture of one or more servers associated with the content scheduling service for coordinating user perceived gapless playback.

While FIG. 3 provides example architecture of a computing device located proximal to a user for providing user perceived gapless playback, FIG. 4 provides an example architecture for one or more servers, which facilitate the cloud services, as described above.

FIG. 4 illustrates an example architecture of one or more servers 400 associated with the content scheduling service for coordinating user perceived gapless content playback. The servers 400 collectively comprise processing resources, as represented by processors 402, and computer-readable storage media 404. The computer-readable storage media 404 may include volatile and nonvolatile memory, removable and non-removable media implemented in any method or technology for storage of information, such as computer-readable instructions, data structures, program modules, or other data. Such memory includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, RAID storage systems, or any other medium which can be used to store the desired information and which can be accessed by a computing device.

Several modules such as instruction, data stores, and so forth may be stored within the computer-readable media 404 and configured to execute on the processors 402. For example, media content modules 406 are provided for locating content delivery services, a network monitoring module 408 is provided to monitor conditions related to the network associated with the computing devices (e.g., computing devices 102, 202-208 and 300), a content scheduling module 410 is provided to select the content items for buffering on the computing devices. Various other modules may also be stored on computer-readable storage media 404.

The content scheduling module 410 may also include various modules, such as a content item selection module 412, a device selection module 414 and a timing module 416. The content item selection module 412 is configured to cause the processors 402 to identify the next content item to buffer on the computing device. The device selection module 414 is configured to determine on which computing devices of a system to buffer the selected content item on and the time module 416 is configured to determine when to a computing device should begin buffering the selected content item from the content delivery service to achieve user perceived gapless playback.

The content scheduling module 410 or the servers 400 may also store playlists 418, records of buffered content items 420 and user information 422. The playlists 418 include one or more customized playlists of content items generated either by or for the users, for example, the playlists 418 may include an action movie marathon list, a country music list, a jazz music list, as well as, different list associated with different users. The buffered content items 420 indicate which content items are stored on which computing devices. The user information 422 may include an identity of the user, authentication credentials, permissions, subscriptions, logon credentials (i.e., passwords and user names), settings, preferences, playlists, lists/indexes related to electronic consumable content (e.g., favorite content items, most skipped content items, most requested content items, etc.), histories (such as consuming histories), and/or other personal information. In some specific implementations, the content scheduling module 410 may also store a collection of content items 424, which may be provided directly to a computing device. The content items 424 may include one or more content items 424 purchased or owned by one or more users, such as movies, songs, games, etc. The servers 400 also include one or more communication interfaces 426, which may support both wired and wireless connection to various networks, such as cellular networks, radio, WiFi networks, short-range or near-field networks (e.g., Bluetooth®), infrared signals, local area networks, wide area networks, the Internet, and so forth. For example, the communication interfaces 426 may allow the cloud services to stream content to the computing devices.

Generally, the servers 400 receive one or more notifications (such as a notification related to an event) from a computing device outputting electronic consumable content to a user and the content scheduling module 410 processes the notification. The content scheduling module 410 then determines if additional content should be buffered on the computing device based on the notification. For example, if the notification indicated that playback of a first buffered content item was started on the computing device, the content scheduling module 410 may determine that a second content item should be buffered while the first content item is playing. However, if the notification indicated that a content item is nearly finished but the buffered content items 422 indicates that two content items are already buffered, the content scheduling module 410 may determine that no additional content needs to be provided at this time.

If the content scheduling module 410 determines that an additional content item should be buffered on the computing device, the content scheduling module 410 causes the content item selection module 412 to access the playlists 418 and the user information 422 to select the content item and to either retrieve the content item from either the content items 424 or to select a content delivery service from which the computing device may obtain the selected content item. The content scheduling module 410 also causes the device selection module 414 to determine which devices to buffering the selected content items on. For example, a system may include a first computing device in the user's living room and a second computing device in the user's kitchen, which are outputting the same content items as a surround sound system. In this example, the first computing device may provide the notifications to the servers 400 on behalf of both the first computing device and the second computing device and the device selection module 414 may select both the first and second computing device to receive scheduling instructions indicating the selected content item and content delivery service.

The content scheduling module 410 may also cause the timing module 416 to determine when the computing device should retrieve the content items from the content delivery service, for instance based on the user preferences and the network conditions. For example, the user may prefer that only a portion of a single content item to be buffered at any one time and the timing module 416 may be configured to access the user information 424 to determine the user preference and to determine the timing based on the user preference and the network conditions, as determined by the network monitoring module 408 or provided by the computing device as part of the notification.

Figure 5:
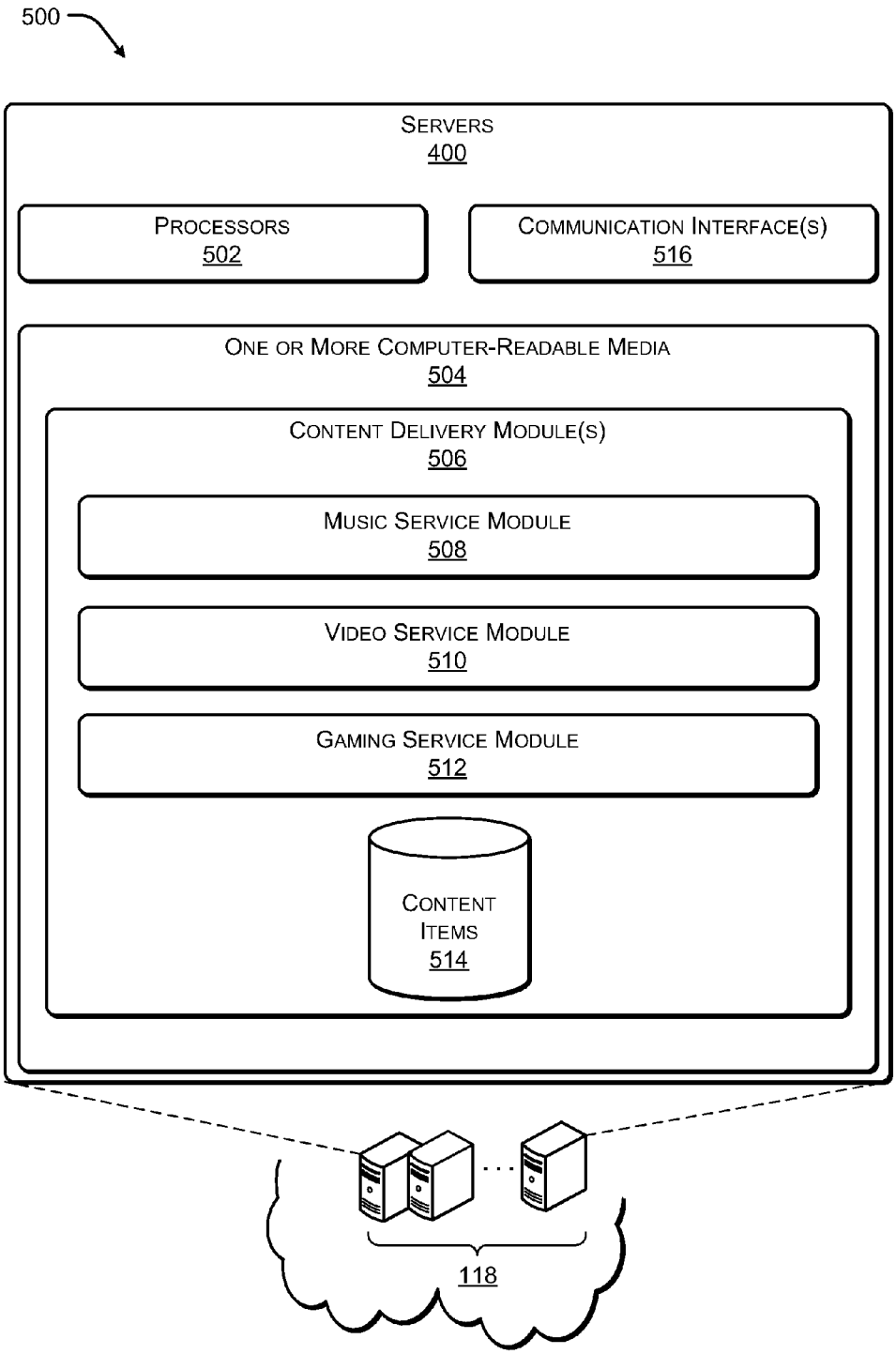
FIG. 5 illustrates an example architecture of one or more servers associated with the content delivery services for providing content items.

FIG. 5 illustrates an example architecture of one or more servers associated with the content delivery services for providing content items. The servers 500 collectively comprise processing resources, as represented by processors 502, and computer-readable storage media 504. The computer-readable storage media 504 may include volatile and nonvolatile memory, removable and non-removable media implemented in any method or technology for storage of information, such as computer-readable instructions, data structures, program modules, or other data. Such memory includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, RAID storage systems, or any other medium which can be used to store the desired information and which can be accessed by a computing device.

Several modules such as instruction, data stores, and so forth may be stored within the computer-readable media 404 and configured to execute on the processors 502. For example, various content delivery modules 506 are provided for streaming content items to one or more computer devices. In the illustrated example, a music service module 508, a video service module 510 and a gaming service module 512 are shown. The music service module 508 is configured to provide songs for buffering on the computing device, the video service module 510 is configured to provide images, movies and/or television episodes for buffering on the computing device and the gaming service module 512 is configured to provide video games and other entrainment for buffering on the computing devices. Various other modules may also be stored on computer-readable storage media 404 to provide additional types of digital content to the computing device.

Each of the content delivery modules 506 or the servers 500 also store content items 514 which may include one or more content items 514 purchased or owned by one or more users, one or more content items 514 that are publically available or one or more content items 514 that are available to the user via one or more subscription service. Generally, the content items 514 include images, movies, songs, games, etc.

The servers 500 also include one or more communication interfaces 516, which may support both wired and wireless connection to various networks, such as cellular networks, radio, WiFi networks, short-range or near-field networks (e.g., Bluetooth®), infrared signals, local area networks, wide area networks, the Internet, and so forth. For example, the communication interfaces 426 may allow the cloud services to stream content to the computing devices.

Generally, the servers 500 receive a content retrieval request from a computing device outputting electronic consumable content to a user. The content retrieval request, typically, indicates one or more selected content items 514 to provide back to the computing device, such that the computing device may buffer the content items 514 for output following the completion of the current content item. The request is routed to one of the music service module 508, the video service module 510 and/or the gaming service module 512 according to type of content item indicated in the content retrieval request. The corresponding module 508, 510 or 512 then identifies the content item 514 and provides the content item 514 back to the computing device.

Illustrative Processes

Figure 6:
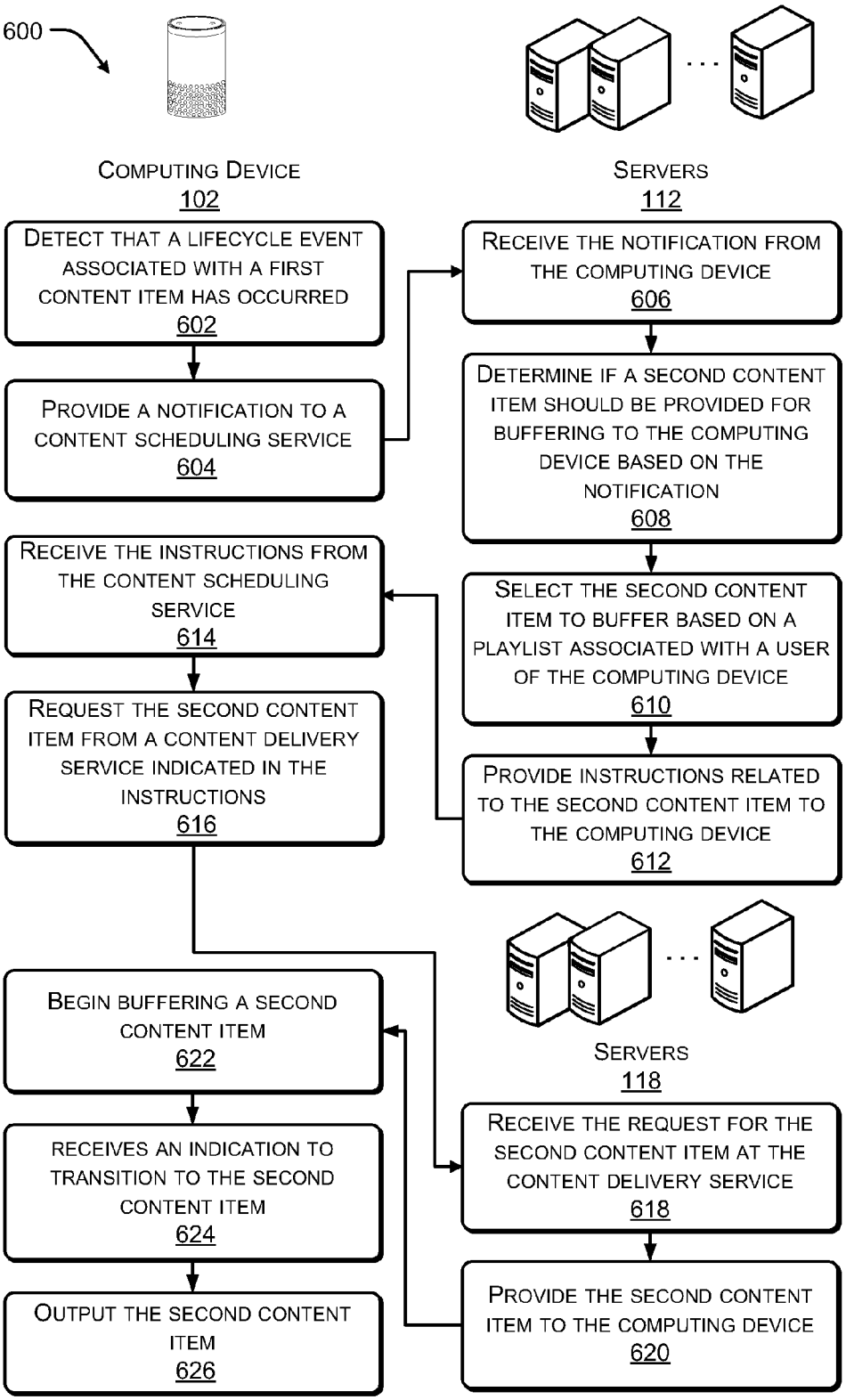
FIG. 6 is an example flow diagram showing an illustrative process to provide user perceived gapless playback.

FIG. 6 is a flow diagram illustrating example processes for implementing user perceived gapless playback. The processes are illustrated as a collection of blocks in a logical flow diagram, which represent a sequence of operations, some or all of which can be implemented in hardware, software or a combination thereof. In the context of software, the blocks represent computer-executable instructions stored on one or more computer-readable media that, which when executed by one or more processors, perform the recited operations. Generally, computer-executable instructions include routines, programs, objects, components, data structures and the like that perform particular functions or implement particular abstract data types.

The order in which the operations are described should not be construed as a limitation. Any number of the described blocks can be combined in any order and/or in parallel to implement the process, or alternative processes, and not all of the blocks need be executed. For discussion purposes, the processes herein are described with reference to the frameworks, architectures and environments described in the examples herein, although the processes may be implemented in a wide variety of other frameworks, architectures or environments.

FIG. 6 is an example flow diagram showing an illustrative process 600 to provide user perceived gapless playback. Generally, a computing device (such as computing device 102, 202-208 or 300) is part of a system having multiple computing devices in communication with each other and/or one or more servers (such as severs 112 implementing the content scheduling service and 116 implementing the content delivery services).

At 602, a computing device detects that an event associated with a first content item has occurred. For instance, the computing device may monitor the consumption of a first content item to determine when certain events occur. For example, the a event may occur when the user begins consuming the content item, pauses the content item, is halfway finished with the content item, when the content item is nearly finished and/or when the content item is finished, among others.

At 604, the computing device provides a notification to a content scheduling service in response to detecting one or more of the events. For example, the computing device may provide the notification to the content scheduling service to inform the content scheduling service that the first content item is nearly finished.

At 606, the content scheduling service receives the notification from the computing device. For example, the content scheduling service may receive notifications related to the output of a content item being consumed by a user of the computing device, such as "Playback Started," "Playback Paused," "Playback Stopped," "Playback Resumed," "Playback Half Finished," "Playback Nearly Finished" and/or "Playback Finished." In another example, the notification may relate to network conditions or user preferences.

At 608, the content scheduling service determines if a second content item should be buffer by the computing device based on the notification. For example, the content scheduling service may determine that the computing device should obtain a content item from a playlist associated with the user, if the notification indicates that the user has begun consuming a previously buffered content item.

At 610, the content scheduling service selects the second content item to buffer based on a playlist associated with a user of the computing device. For example, the content scheduling service may identify the second content item from a currently streaming playlist selected by the user or from a playlist previously generated by the user. In one example, the content scheduling service may select a playlist to begin following based on user preferences and/or user history if no playlist is currently selected.

At 612, the content scheduling service provides instructions related to the second content item to the computing device, such that the computing device is able to obtain and at least partially, buffer the second content item before the first content item is completely consumed by the user. In this manner, the user is able to experience substantially gapless playback between content items and/or between playlist selections.

A6 614, the computing device receives the instructions from the content scheduling service. The instructions include data (or meta-data) related to the second content item and a content delivery service from which to obtain the second content item. In some examples, the instructions may include a list of content delivery services each of which may be able to provide the computing device with the second content item.

At 616, the computing device requests the second content item from the content delivery service indicated in the instructions. For example, the computing device may send a content retrieval request to the content delivery service as described above with respect to FIG. 1.

At 618, the content delivery service receives the request for the second content item from the computing device and the content delivery service located the second content item. For example, the content delivery service may include one or more repository of electronic consumable content, such as one or more music databases, one or more movie databases, one or more television episode databases, etc.

At 620, the content delivery service provides the second content item to the computing device and, at 622, the computing device begins to buffer a second content item. For example, the computing device may buffer a predetermined amount of the second content item, while the first content item is being output or the entire second content item based on the instructions from the content scheduling service and/or the configuration of the computing device. For instance, if the computing device has limited memory and the content item is large, the computing device may buffer only a portion of the content item at any time.

At 624, the computing device receives an indication to transition to the second content item. For example, the indication may be in response to completion of the first content item a user selection, such as to skip a content item or fast forward. In another example, the indication may be from the computing device and or the cloud services, for instance, according to a randomized play time setting or a preview function.

At 626, the computing device outputs the second content item in response to receiving the indication to transition to the second content item. For example, the indication may be the completion of the first content item and the computing device may be configure to output the buffered portion of the second content item immediately following the completion of the first content item, such that the user experiences a substantially gapless playback when switching content items.

CONCLUSION

Although the subject matter has been described in language specific to structural features, it is to be understood that the subject matter defined in the appended claims is not necessarily limited to the specific features described. Rather, the specific features are disclosed as illustrative forms of implementing the claims.

What is claimed is:

1. A system comprising:

a computing device in communication with one or more cloud services, the computing device comprising:
- at least one speaker to output audio to a user;
- one or more communication interfaces to communicate with the one or more cloud services;
- one or more processors; and
- computer-readable storage media storing computer-executable instructions, which when executed by the one or more processors cause the processors to:
  - receive a first instruction from a content scheduling service to obtain a first content item;
  - request the first content item from a content delivery service;
  - receive the first content item from the content delivery service;
  - output the first content item from the speaker;
  - detect an event related to outputting the first content item from the speaker;
  - cause the communication interface to provide a notification related to the event to the content scheduling service;
  - receive a second instruction from the content scheduling service to obtain a second content item;
  - request the second content item from a content delivery service;
  - receive the second content item from the content delivery service;
  - buffer the second content item while the speaker outputs the first content item;
  - determine an end time of the first content item; and
  - output the second content item so that a beginning of the second content item is output substantially immediately after the end of the first content item.

2. The computing system as recited in claim 1, wherein the first and second content items comprise audio content items.

3. The computing system as recited in claim 1, wherein the event is related to at least one of:
- receiving an indication from a user to skip the first content item;
- a start of the output of the first content item;
- a pause in the output of the first content item;
- a predetermined amount of the first content item having been consumed;
- approximately half of the first content item having been consumed;
- an end of the output of the first content item; or
- a stop in the output of the first content item.

4. The computing system as recited in claim 1, wherein the notification includes at least one of:
- current progress of the user through the first content item;
- a number of pauses of the first content item;
- a frequency of pauses of the first content item;
- playback time remaining in the first content item;
- amount of content remaining in the first content item;
- amount of content consumed in the first content item;
- user's average rate of consumption of the first content item;
- one or more network condition;
- data related to device outputting the first content item; or
- a number of other content items buffered on the computing device.

5. A method comprising:

under control of one or more computer systems configured with executable instructions, outputting a first content item from a speaker;

providing a notification to a content scheduling service, the notification including data related to the output of the first content item;

receiving, from the content scheduling service, instructions to obtain a second content item from a content delivery service;

requesting the second content item from the content delivery service;

receiving the second content item from the content delivery service;

buffering the second content item while outputting the first content item to the user;

determining to transition from the first content item to the second content item; and outputting the second content item from the speaker such that output is substantially continuous from the first content item to the second content item.

6. The method as recited in claim 5, wherein providing the notification is in response to detecting an event related to the output of the first content item.

7. The method as recited in claim 5, wherein the notification is provided to the content scheduling service on a periodic basis.

8. The method as recited in claim 5, further comprising monitoring network conditions related to receiving the second content item from the content delivery service.

9. The method as recited in claim 8, wherein providing the notification is in response to a change in a network condition.

10. The method as recited in claim 5, wherein determining to transition from the first content item to the second content item comprises at least one of:

determining completion of the first content item;

receiving instruction from a user;

receiving instructions from the content scheduling service; or receiving instructions from another computing system.

11. The method as recited in claim 5, wherein the instructions include at least one uniform resource locator (URL) from which to obtain the second content item.

12. One or more non-transitory computer-readable media having computer-executable instructions that, when executed by one or more processors, cause the one or more processors to perform operations comprising:

outputting a first content item at a speaker;

providing a notification to a content scheduling service, the notification including data related to the outputting of the first content item;

receiving, from the content scheduling service, instructions to obtain a second content item, the instructions including data related to a content delivery service from which to retrieve the second content item;

requesting the second content item from the content delivery service; and buffering the second content item while outputting the first content item.

13. The one or more non-transitory computer-readable media as recited in claim 12, having computer-executable instructions that, when executed by one or more processors, cause the one or more processors to perform operations comprising providing a notification related to an output of the second content item.

14. The one or more non-transitory computer-readable media as recited in claim 12, wherein the notification is provided in response to detecting an event related to the output of the first content item.

15. The one or more non-transitory computer-readable media as recited in claim 14, wherein the event is related to at least one of:

receiving an indication from a user to skip the first content item;

a start of the output of the first content item;

a pause in the output of the first content item;

a predetermined amount of the first content item having been consumed;

approximately half of the first content item having been consumed;

an end of the output of the first content item; or a stop in the output of the first content item.

16. The one or more non-transitory computer-readable media as recited in claim 12, wherein the notification includes an indication of a location of a user.

17. The one or more non-transitory computer-readable media as recited in claim 12, wherein the data related to a content delivery service includes a list of content delivery services from which to obtain the second content item.

18. The one or more non-transitory computer-readable media as recited in claim 12, having computer-executable instructions that, when executed by one or more processors, cause the one or more processors to perform operations comprising:

providing a second notification to the content scheduling service, the second notification including data related to the output of the second content item;

receiving instructions to obtain a third content item, the instructions including data related to a content delivery service from which to retrieve the third content item;

requesting the third content item from the content delivery service from which to retrieve the third content item; and buffering the third content item while outputting the second content item.

19. The one or more non-transitory computer-readable media as recited in claim 12, having computer-executable instructions that, when executed by one or more processors, cause the one or more processors to perform operations comprising outputting the second content item following an indication to transition from the first content item to the second content item.

20. The one or more non-transitory computer-readable media as recited in claim 12, having computer-executable instructions that, when executed by one or more processors, cause the one or more processors to perform operations comprising determining a time at which to request the second content item from the content delivery service.

* * * * *